US007538743B1

(12) United States Patent
Chantz

(10) Patent No.: US 7,538,743 B1
(45) Date of Patent: May 26, 2009

(54) BALANCED AND SHORTENED ANTENNAS

(75) Inventor: Hyman D. Chantz, Scarsdale, NY (US)

(73) Assignee: International Business Machines Corporation, Armonk, NY (US)

( * ) Notice: Subject to any disclaimer, the term of this patent is extended or adjusted under 35 U.S.C. 154(b) by 13 days.

(21) Appl. No.: 11/940,391

(22) Filed: Nov. 15, 2007

(51) Int. Cl.
*H01Q 1/36* (2006.01)

(52) U.S. Cl. ..... 343/895; 343/788; 343/896; 343/898

(58) Field of Classification Search ..... 343/788, 343/895–896, 898
See application file for complete search history.

(56) References Cited

U.S. PATENT DOCUMENTS

| | | | | |
|---|---|---|---|---|
| 3,906,509 | A * | 9/1975 | DuHamel | 343/895 |
| 4,489,276 | A * | 12/1984 | Yu | 324/338 |
| 5,453,755 | A * | 9/1995 | Nakano et al. | 343/872 |
| 5,928,145 | A | 7/1999 | Ocali et al. | |
| 6,011,525 | A * | 1/2000 | Piole | 343/895 |
| 6,075,501 | A * | 6/2000 | Kuramoto et al. | 343/895 |
| 6,169,523 | B1 * | 1/2001 | Ploussios | 343/895 |
| 6,172,655 | B1 | 1/2001 | Volman | |
| 6,333,722 | B1 * | 12/2001 | Kitano | 343/895 |
| 6,344,834 | B1 * | 2/2002 | Josypenko | 343/895 |
| 6,388,626 | B1 * | 5/2002 | Gamalielsson et al. | 343/702 |
| 6,501,438 | B2 | 12/2002 | Nevermann et al. | |
| 6,606,513 | B2 | 8/2003 | Lardo et al. | |
| 7,183,998 | B2 | 2/2007 | Wilhelm et al. | |
| 2007/0146226 | A1 * | 6/2007 | Oh et al. | 343/873 |
| 2008/0105826 | A1 * | 5/2008 | Mercure et al. | 250/394 |

* cited by examiner

*Primary Examiner*—Rexford Barnie
*Assistant Examiner*—Jason Crawford
(74) *Attorney, Agent, or Firm*—Schmeiser, Olsen & Watts; Anna Linne

(57) ABSTRACT

An antenna for radiating and/or receiving signals. The antenna includes (i) a first hollow and helical pipe, (ii) a second hollow and helical pipe, (iii) a first transmission wire, (iv) a second transmission wire, and (v) a dielectric connector. The dielectric connector physically couples to the first hollow and helical pipe and the second hollow and helical pipe. The first hollow and helical pipe and the second hollow and helical pipe comprise an electrically conductive material. The first transmission wire comprises a first portion and a second portion. The second transmission wire comprises a third portion and a fourth portion. The first portion of the first transmission wire and the third portion of the second transmission wire are inside the first hollow and helical pipe.

20 Claims, 1 Drawing Sheet

BALANCED AND SHORTENED ANTENNAS

FIELD OF THE INVENTION

The present invention relates generally to antennas, and more particularly to shortened antennas which are substantially balanced in their emission and reception fields.

BACKGROUND OF THE INVENTION

A typical antenna is used to generate signals to the surrounding space and/or receive signals from the surrounding space. There is often a need to make the antenna physically shortened, and with as balanced or symmetrical a radio-frequency field as possible. When end-fed (FIG. 1) this balancing efficiency improves coupling to the free-space environment, and reduces non-wanted coupling into local conductive or dielectric objects. When center fed (FIG. 2) there is the additional advantage of reduced coupling from interfering noise sources.

SUMMARY OF THE INVENTION

The present invention provides a structure, comprising a first hollow and helical pipe; a second hollow and helical pipe; a first transmission wire; a second transmission wire; and a dielectric connector physically coupled to the first hollow and helical pipe and the second hollow and helical pipe, wherein the first hollow and helical pipe and the second hollow and helical pipe comprise an electrically conductive material, wherein the first transmission wire comprises a first portion and a second portion, wherein the second transmission wire comprises a third portion and a fourth portion, and wherein the first portion of the first transmission wire and the third portion of the second transmission wire are inside the first hollow and helical pipe.

The present invention provides an antenna that is balanced and shorter than that of the prior art.

DETAILED DESCRIPTION OF THE INVENTION

Figure 1:
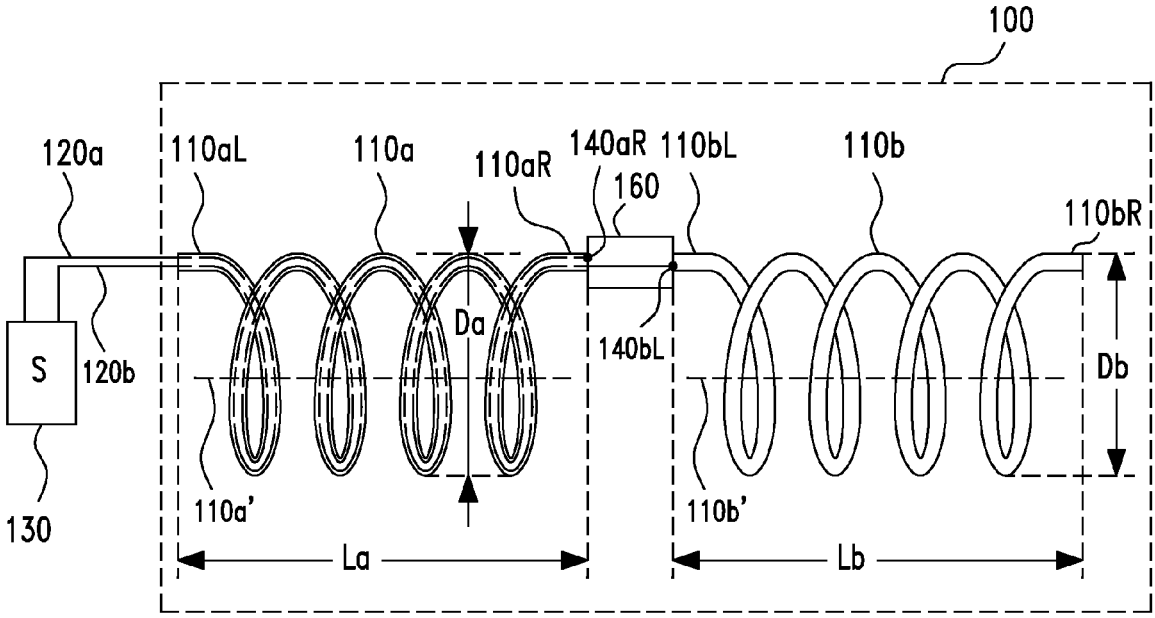
FIG. 1 shows a side-view of a dipole antenna and a signal source electrically coupled to the dipole antenna, in accordance with embodiments of the present invention.

FIG. 1 shows a side-view of a dipole antenna 100 and a signal source 130 electrically coupled to the dipole antenna 100, in accordance with embodiments of the present invention. More specifically, with reference to FIG. 1, the dipole antenna 100 comprises hollow helix radiating elements 110*a* and 110*b* and transmission wires 120*a* and 120*b*. The hollow helix radiating elements 110*a* and 110*b* can be hollow and helical pipes. The hollow helix radiating elements 110*a* and 110*b* can be formed by winding two straight hollow pipes into helical shape. Alternatively, it can be formed by a coaxial cable manufactured with two center conductors. In one embodiment, the helical axis 110*a*' of the hollow helix radiating element 110*a* and the helical axis 110*b*' of the hollow helix radiating element 110*b* are on the same straight line.

Each of the hollow helix radiating elements 110*a* and 110*b* can be right-handed or left-handed. With the line of sight being helical axis, if clockwise movement of the helix corresponds to axial movement away from the observer, then it is a right-handed helix. If counter-clockwise movement corresponds to axial movement away from the observer, then it is a left-handed helix. It should be noted that the hollow helix radiating elements 110*a* and 110*b* shown in FIG. 1 are left-handed. If both the hollow helix radiating elements 110*a* and 110*b* are left-handed or if both the hollow helix radiating elements 110*a* and 110*b* are right-handed, it is said that the hollow helix radiating elements 110*a* and 110*b* are wound in the same direction. In an alternative embodiment, one of the hollow helix radiating elements 110*a* and 110*b* is left-handed whereas the other is right-handed.

In one embodiment, the hollow helix radiating element 110*a* comprises a left end 110*a*L and a right end 110*a*R. The hollow helix radiating element 110*b* comprises a left end 110*b*L and a right end 110*b*R. The hollow helix radiating elements 110*a* and 110*b* can comprise an electrically conductive material. In one embodiment, the hollow helix radiating elements 110*a* and 110*b* are electrically insulated from each other. A dielectric connector 160 can be used to physically couple the hollow helix radiating elements 110*a* and 110*b* together so as to keep the hollow helix radiating elements 110*a* and 110*b* in place.

Let La and Lb represent axial lengths of the hollow helix radiating elements 110*a* and 110*b*, respectively. Let Da and Db represent diameters of the hollow helix radiating elements 110*a* and 110*b*, respectively. Let Lta and Ltb (not shown) represent the physical lengths of the hollow helix radiating elements 110*a* and 110*b*, respectively. The physical length of the hollow helix radiating element 110*a* is a length measured from the left end 110*a*L to the right end 110*a*R along the solid body of the hollow helix radiating element 110*a*. Similarly, the physical length of the hollow helix radiating element 110*b* is a length measured from the left end 110*b*L to the right end 110*b*R along the solid body of the hollow helix radiating element 110*b*. This is shorter than the physical length, while still being balanced. In one embodiment, $Lta=Ltb=\lambda/4$ (allowing plus and minus 10% tolerance), wherein $\lambda$ is the wavelength of the signal generated by the signal source 130. In other words, the dipole antenna 100 is essentially a half-wave dipole antenna. For example, at a signal frequency of 46 MHz ($\lambda$~6.2 m), Lta=Ltb=1.550 m. With plus and minus 10% tolerance, each of Lta and Ltb can be in the range of 1.395 m to 1.705 m. The physical lengths (i.e., La and Lb) can be shorter.

In one embodiment, the transmission wires 120*a* and 120*b* are electrically conductive wires. A portion of the transmission wire 120*a* and a portion of the transmission wire 120*b* are inside the hollow helix radiating element 110*a* and electrically insulated from each other. In one embodiment, the transmission wires 120*a* and 120*b* are shielded (covered) by a dielectric material such that the transmission wires 120*a* and 120*b* are electrically insulated from each other and electrically insulated from the hollow helix radiating element 110*a*.

In one embodiment, one end of the transmission wire 120*a* is electrically connected to the signal source 130, whereas the other end of the transmission wire 120*a* is electrically connected to the right end 110*a*R of the hollow helix radiating element 110*a*. The connection point 140*a*R represents electrical connection of the transmission wire 120*a* and the right end 110*a*R. In one embodiment, the transmission wire 120*a* is electrically connected to the hollow helix radiating element 110*a* via an electric path that goes through the right end 110*a*R such that there is no electric path between the transmission wire 120*a* and the hollow helix radiating element 110*a* that does not go through the right end 110*a*R. It should be noted that the transmission wire 120*a* is not electrically connected to the hollow helix radiating element 110*b*.

In one embodiment, one end of the transmission wire 120*b* is electrically connected to the signal source 130, whereas the other end of the transmission wire 120*b* is electrically connected to the left end 110*b*L of the hollow helix radiating element 110*b*. The connection point 140*b*L represents electrical connection of the transmission wire 120*b* and the left end 110*b*L. In one embodiment, the transmission wire 120*b* is electrically connected to the hollow helix radiating element 110*b* via an electric path that goes through the left end 110*b*L such that there is no electric path between the transmission wire 120*b* and the hollow helix radiating element 110*b* that does not go through the left end 110*b*L. It should be noted that the transmission wire 120*b* is not electrically connected to the hollow helix radiating element 110*a*. The dipole antenna 100 receives signal from the signal source 130 via the transmission wires 120*a* and 120*b* and radiates the received signal to the surrounding space using the hollow helix radiating elements 110*a* and 110*b*.

In one embodiment, two IBM TwinAx™ cable segments can be used to create the hollow helix radiating elements 110*a* and 110*b* and the transmission wires 120*a* and 120*b*. More specifically, the first IBM TwinAx™ cable segment is used as the hollow helix radiating element 110*a* and the transmission wires 120*a* and 120*b*. The second IBM TwinAx™ cable is used as the hollow helix radiating element 110*b*, wherein the two transmission wires of the second IBM TwinAx™ cable segment are not used (i.e., not electrically connected to anything).

It should be noted that the hollow helix radiating elements 110*a* and 110*b* are in shape of helix. Therefore, the axial lengths La and Lb of the hollow helix radiating elements 110*a* and 110*b*, respectively, are much shorter than their physical lengths Lta and Ltb. In the example above in which the physical lengths Lta and Ltb are equal to 1.55 m, the axial lengths La and Lb can be a few centimeters.

In one embodiment, the electromagnetic fields generated by transmitted signals on the portions of the transmission wires 120*a* and 120*b* inside the hollow helix radiating element 110*a* exists only in the space within the hollow helix radiating element 110*a*. As a result, the electromagnetic fields generated by transmitted signals on the portions of the transmission wires 120*a* and 120*b* inside the hollow helix radiating element 110*a* does not affect the radio wave generated by the hollow helix radiating elements 110*a* and 110*b*, as well as the radio wave transmitted to the hollow helix radiating elements 110*a* and 110*b* via the surrounding space (if any).

In one embodiment, the portions of the transmission wires 120*a* and 120*b* outside the hollow helix radiating element 110*a* are arranged in proximity such that the electromagnetic fields generated by transmitted signals on these portions essentially cancel each other out.

It should be noted that the current flowing into the hollow helix radiating element 110*a* is equal to the current flowing into the hollow helix radiating element 110*b*.

It should be noted that, with reference to FIG. 1, the dipole antenna 100 is an end-fed antenna. More specifically, the signal generated by the signal source 130 is fed at one end (the left end 110*a*L) of the dipole antenna 100. It should be noted that the dipole antenna 100 has two ends: the left end 110*a*L and the right end 110*b*R. The dipole antenna 100 can be used for operation in HF (high frequency) bandwidth, VHF (very high frequency) bandwidth, and UHF (ultra-high frequency) bandwidth.

In summary, with the two transmission wires 120*a* and 120*b* running inside the hollow helix radiating element 110*a*, the dipole antenna 100 is end-fed, balanced, and shortened (La and Lb are much shorter than Lta and Ltb).

Figure 2:
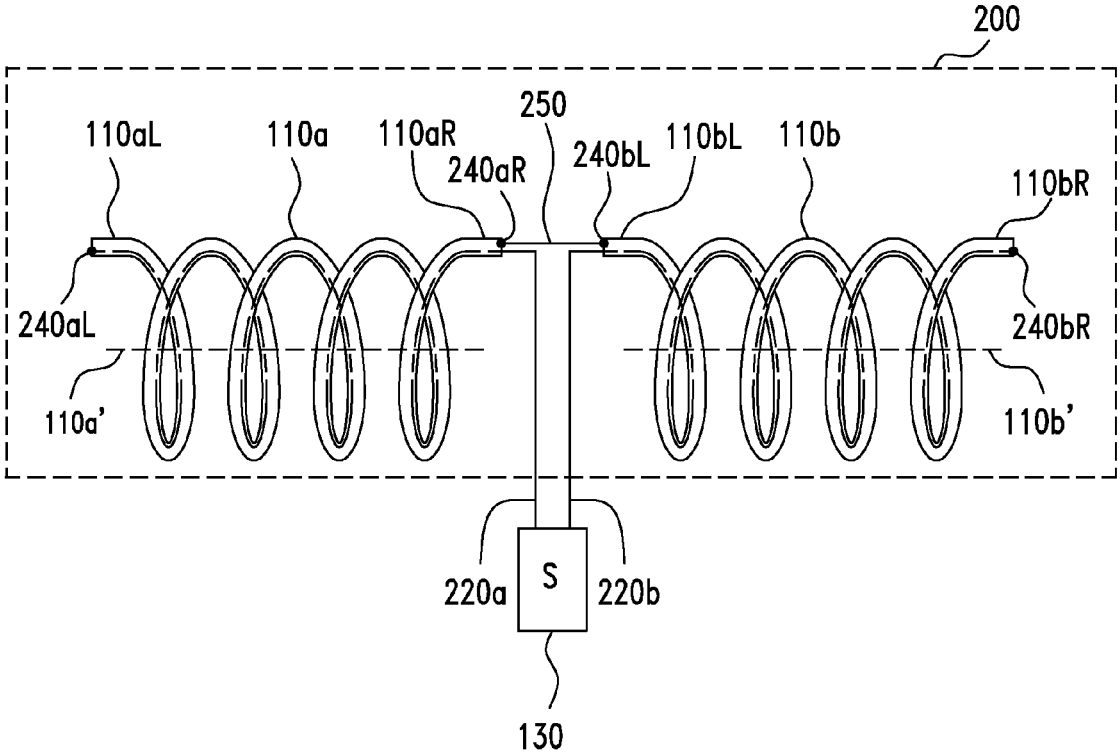
FIG. 2 shows a side-view of a folded dipole antenna and a signal source electrically coupled to the folded dipole antenna, in accordance with embodiments of the present invention.

FIG. 2 shows a side-view of a folded dipole antenna 200 and the signal source 130 electrically coupled to the folded dipole antenna 200, in accordance with embodiments of the present invention. More specifically, with reference to FIG. 2, the folded dipole antenna 200 comprises the hollow helix radiating elements 110*a* and 110*b*, transmission wires 220*a* and 220*b*, and a connection wire 250. In one embodiment, the helical axis 110*a*' of the hollow helix radiating element 110*a* and the helical axis 110*b*' of the hollow helix radiating element 110*b* are on the same straight line. In one embodiment, the hollow helix radiating elements 110*a* and 110*b* are electrically connected to each other via an electric path that goes through the right end 110*a*R and the left end 110*b*L such that there is no electric path between the hollow helix radiating elements 110*a* and 110*b* that does not go through right end 110*a*R and the left end 110*b*L. More specifically, the hollow helix radiating elements 110*a* and 110*b* are electrically connected to each other via only the connection wire 250 at connection points 240*a*R and 240*b*L, as shown in FIG. 2.

In one embodiment, the transmission wires 220*a* and 220*b* are electrically conductive wires. A portion of the transmission wire 220*a* is inside the hollow helix radiating element 110*a*, whereas a portion of the transmission wire 220*b* is inside the hollow helix radiating element 110*b*. In one embodiment, the transmission wires 220*a* and 220*b* are shielded (covered) by a dielectric material such that the transmission wires 220*a* and 220*b* are electrically insulated from the hollow helix radiating elements 110*a* and 110*b*, respectively, and such that the transmission wires 220*a* and 220*b* are electrically insulated from each other. The advantage of FIG. 2 is that the antenna picks up less electrical noise, and is effectively shielded from non-resonant interference.

In one embodiment, one end of the transmission wire 220*a* is electrically connected to the signal source 130, whereas the other end of the transmission wire 220*a* is electrically connected to the left end 110*a*L of the hollow helix radiating element 110*a* at the connection point 240*a*L. The connection point 240*a*L represents electrical connection of the transmission wire 220*a* and the left end 110*a*L. In one embodiment, the transmission wire 220*a* is electrically connected to the hollow helix radiating element 110*a* via an electric path that goes through the left end 110*a*L such that there is no electric path between the transmission wire 220*a* and the hollow helix radiating element 110*a* that does not go through the left end 110*a*L.

Similarly, one end of the transmission wire 220*b* is electrically connected to the signal source 130, whereas the other end of the transmission wire 220*b* is electrically connected to the right end 110*b*R of the hollow helix radiating element 110*b* at the connection point 240*b*R. The connection point 240*b*R represents electrical connection of the transmission wire 220*b* and the right end 110*b*R. In one embodiment, the transmission wire 220*b* is electrically connected to the hollow helix radiating element 110*b* via an electric path that goes through the right end 110*b*R such that there is no electric path between the transmission wire 220*b* and the hollow helix radiating element 110*b* that does not go through the right end 110*b*R. The folded dipole antenna 200 receives signal from the signal source 130 via the transmission wires 220*a* and 220*b* and radiates the received signal to the surrounding space using the hollow helix radiating elements 110*a* and 110*b*.

In one embodiment, two IBM TwinAx™ cable segments are used to create the hollow helix radiating elements 110*a* and 110*b* and the transmission wires 120*a* and 120*b* of FIG. 2. More specifically, the first IBM TwinAx™ cable segment is used as the hollow helix radiating element 110*a* and the transmission wire 220*a*. The other transmission wire of the first IBM TwinAx™ cable segment is not used (i.e., not electrically connected to anything). The second IBM TwinAx™ cable is used as the hollow helix radiating element 110*b* and the transmission wire 220*b*. The other transmission wire of the second IBM TwinAx™ cable segment is not used (i.e., not electrically connected to anything). Alternatively, each of the hollow helix radiating elements 110*a* and 110*b* of FIG. 2 can be formed using a regular coax cable with one center conductor or can be formed by winding a hollow tube with an inner conductor into a helix.

It should be noted that the hollow helix radiating elements 110*a* and 110*b* are in shape of helix. Therefore, the axial lengths La and Lb of the hollow helix radiating elements 110*a* and 110*b*, respectively, are much shorter than their physical lengths Lta and Ltb. In the example above in which the physical lengths Lta and Ltb are equal to 1.55 m, the axial lengths La and Lb can be a few centimeters.

It should be noted that the electromagnetic fields generated by transmitted signals on the portions of the transmission wires 220*a* and 220*b* inside the hollow helix radiating elements 110*a* and 110*b* exists only in the space within the hollow helix radiating elements 110*a* and 110*b*. As a result, the electromagnetic fields generated by transmitted signals on the portions of the transmission wires 220*a* and 220*b* inside the hollow helix radiating elements 110*a* and 110*b* does not affect the radio wave generated by the hollow helix radiating elements 110*a* and 110*b*, as well as the radio wave transmitted to the hollow helix radiating elements 110*a* and 110*b* via the surrounding space (if any).

In one embodiment, the portions of the transmission wires 220*a* and 220*b* outside the hollow helix radiating elements 110*a* and 110*b*, respectively, are arranged in proximity such that the electromagnetic fields generated by transmitted signals on these portions essentially cancel each other out.

It should be noted that the current flowing into the hollow helix radiating element 110*a* is equal to the current flowing into the hollow helix radiating element 110*b*, Therefore, the dipole antenna 110 is a balanced antenna.

It should be noted that, with reference to FIG. 2, the folded dipole antenna 200 is a center-fed antenna. More specifically, the signal generated by the signal source 130 is fed at exact center of the folded dipole antenna 100. The folded dipole antenna 200 can be used for operation in HF (high frequency) bandwidth, VHF (very high frequency) bandwidth, and UHF (ultra-high frequency) bandwidth.

In the embodiments described above, the hollow helix radiating elements 110*a* and 110*b* are electrically connected to each other by the connection wire 250. In an alternative embodiment, the hollow helix radiating elements 110*a* and 110*b* are bonded together such that the connection points 240*a*R and 240*b*L are in direct physical contact with each other. In other words, the right end 110*b*L of the hollow helix radiating element 110*a* and the left end 110*b*L of the hollow helix radiating element 110*b* are in direct physical contact with each other.

In summary, with the two transmission wires 220*a* and 220*b* running inside the hollow helix radiating elements 110*a* and 110*b*, respectively, the folded dipole antenna 200 is end-fed, balanced, and shortened (La and Lb are much shorter than Lta and Ltb).

In the embodiments described above, the dipole antenna 100 of FIG. 1 and the folded dipole antenna 200 of FIG. 2 receive signals from the signal source 130. Alternatively, the dipole antenna 100 and the folded dipole antenna 200 are used to receive signals from the surrounding space.

While particular embodiments of the present invention have been described herein for purposes of illustration, many modifications and changes will become apparent to those skilled in the art. Accordingly, the appended claims are intended to encompass all such modifications and changes as fall within the true spirit and scope of this invention.

What is claimed is:

1. A structure, comprising:

a first hollow and helical pipe;

a second hollow and helical pipe;

a first transmission wire;

a second transmission wire; and a dielectric connector physically coupled to the first hollow and helical pipe and the second hollow and helical pipe, wherein the first hollow and helical pipe and the second hollow and helical pipe comprise an electrically conductive material, wherein the first transmission wire comprises a first portion and a second portion, wherein the second transmission wire comprises a third portion and a fourth portion, and wherein the first portion of the first transmission wire and the third portion of the second transmission wire are inside the first hollow and helical pipe.

2. The structure of claim 1, wherein the first hollow and helical pipe comprises a first end and a second end, wherein the second hollow and helical pipe comprises a third end and a fourth end, wherein the first transmission wire is electrically coupled to the first hollow and helical pipe via a first electric path that goes through the second end of the first hollow and helical pipe, and wherein the second transmission wire is electrically coupled to the second hollow and helical pipe via a second electric path that goes through the third end of the second hollow and helical pipe.

3. The structure of claim 2, wherein there is no electric path between the first transmission wire and the first hollow and helical pipe that does not go through the second end, and wherein there is no electric path between the second transmission wire and the second hollow and helical pipe that does not go through the third end.

4. The structure of claim 2, wherein the dielectric connector is in direct physical contact with the second end of the first hollow and helical pipe, and wherein the dielectric connector is in direct physical contact with the third end of the second hollow and helical pipe.

5. The structure of claim 1, wherein the first hollow and helical pipe is left-handed, and wherein the second hollow and helical pipe is right-handed.

6. The structure of claim 1, wherein a first helical axis of the first hollow and helical pipe and a second helical axis of the second hollow and helical pipe are on a same straight line.

7. The structure of claim 1, further comprising a signal source, wherein the signal source is electrically coupled to the first and second transmission wires, and wherein the first hollow and helical pipe, the first portion of the first transmission wire, and the third portion of the second transmission wire are parts of an IBM TwinAx™ cable segment.

8. The structure of claim 7, wherein a sum of a first physical length of the first hollow and helical pipe and a second physical length of the second hollow and helical pipe is essentially equal to a half of a wavelength of a signal which the signal source is configured to generate.

9. The structure of claim 8, wherein the first physical length is essentially equal to the second physical length.

10. The structure of claim 1, wherein the second portion of the first transmission wire and the fourth portion of the second transmission wire are arranged in proximity such that electromagnetic fields generated by signals transmitted on the second and fourth portions essentially cancel each other out.

11. A structure, comprising:

a first hollow and helical pipe;

a second hollow and helical pipe;

a first transmission wire; and a second transmission wire, wherein the first hollow and helical pipe and the second hollow and helical pipe comprise an electrically conductive material, wherein the first transmission wire comprises a first portion and a second portion, wherein the second transmission wire comprises a third portion and a fourth portion, wherein the first hollow and helical pipe comprises a first end and a second end, wherein the second hollow and helical pipe comprises a third end and a fourth end, wherein the first portion of the first transmission wire is inside the first hollow and helical pipe, wherein the third portion of the second transmission wire is inside the second hollow and helical pipe, wherein the first hollow and helical pipe is electrically coupled to the second hollow and helical pipe via a connecting electric path, wherein the second end of the first hollow and helical pipe is on the connecting electric path, and wherein the third end of the second hollow and helical pipe is on the connecting electric path.

12. The structure of claim 11, wherein there is no electric path between the first hollow and helical pipe and the second hollow and helical pipe that does not go through both the second end and the third end.

13. The structure of claim 11, wherein the first transmission wire is electrically coupled to the first hollow and helical pipe via a first electric path that goes through the first end of the first hollow and helical pipe, wherein the second transmission wire is electrically coupled to the second hollow and helical pipe via a second electric path that goes through the fourth end of the second hollow and helical pipe, wherein there is no electric path between the first transmission wire and the first hollow and helical pipe that does not go through the first end of the first hollow and helical pipe, and wherein there is no electric path between the second transmission wire and the second hollow and helical pipe that does not go through the fourth end of the second hollow and helical pipe.

14. The structure of claim 11, further comprising a signal source, wherein the signal source is electrically coupled to the first and second transmission wires, wherein a sum of a first physical length of the first hollow and helical pipe and a second physical length of the second hollow and helical pipe is essentially equal to a half of a wavelength of a signal which the signal source is configured to generate, and wherein the first physical length is essentially equal to the second physical length.

15. The structure of claim 11, wherein the second portion of the first transmission wire and the fourth portion of the second transmission wire are arranged in proximity such that electromagnetic fields generated by signals transmitted on the second and fourth portions essentially cancel each other out, wherein the first hollow and helical pipe and the second hollow and helical pipe are wound in a same direction, wherein the first hollow and helical pipe and the first portion of the first transmission wire are parts of a first regular coaxle cable, and wherein the second hollow and helical pipe and the third portion of the second transmission wire are parts of a second regular coaxle cable.

16. The structure of claim 11, wherein the second end of the first hollow and helical pipe is in direct physical contact with the third end of the second hollow and helical pipe.

17. A structure formation method, comprising:

providing a first hollow and helical pipe, a second hollow and helical pipe, a first transmission wire, a second transmission wire, and a dielectric connector, wherein the first hollow and helical pipe and the second hollow and helical pipe comprise an electrically conductive material;

using the dielectric connector to physically couple the first hollow and helical pipe to the second hollow and helical pipe; and placing a first portion of the first transmission wire and a third portion of the second transmission wire inside the first hollow and helical pipe.

18. The method of claim 17, further comprising:

electrically coupling the first transmission wire to the first hollow and helical pipe via a first electric path that goes through a second end of the first hollow and helical pipe; and electrically coupling the second transmission wire to the second hollow and helical pipe via a second electric path that goes through a third end of the second hollow and helical pipe, wherein there is no electric path between the first transmission wire and the first hollow and helical pipe that does not go through the second end, and wherein there is no electric path between the second transmission wire and the second hollow and helical pipe that does not go through the third end.

19. The method of claim 17, further comprising electrically coupling a signal source to the first and second transmission wires, wherein a sum of a first physical length of the first hollow and helical pipe and a second physical length of the second hollow and helical pipe is essentially equal to a half of a wavelength of a signal which the signal source is configured to generate, and wherein the first physical length is essentially equal to the second physical length.

20. The method of claim 17, further comprising placing a second portion of the first transmission wire and a fourth portion of the second transmission wire in proximity such that electromagnetic fields generated by signals transmitted on the second and fourth portions essentially cancel each other out.

* * * * *